US006736683B2

(12) United States Patent
Brand et al.

(10) Patent No.: US 6,736,683 B2
(45) Date of Patent: May 18, 2004

(54) ELECTRICAL TERMINAL

(75) Inventors: Jurgen Brand, Detmold (DE); Oliver Lange, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 72 days.

(21) Appl. No.: 10/124,488

(22) Filed: Apr. 18, 2002

(65) Prior Publication Data

US 2002/0155760 A1 Oct. 24, 2002

(30) Foreign Application Priority Data

Apr. 18, 2001 (DE) ..... 201 06 710 U

(51) Int. Cl.[7] ..... H01R 4/48
(52) U.S. Cl. ..... 439/828; 439/912
(58) Field of Search ..... 439/441, 482, 439/828, 912

(56) References Cited

U.S. PATENT DOCUMENTS 5,588,881 A * 12/1996 Eggert et al. ..... 439/709
5,626,488 A 5/1997 Albeck et al.
5,679,021 A * 10/1997 Kramer ..... 439/835
5,863,215 A * 1/1999 Debbaut et al. ..... 439/412
6,074,241 A * 6/2000 Patel et al. ..... 439/441
6,120,315 A * 9/2000 Gaertner et al. ..... 439/395
6,280,233 B1 * 8/2001 Beege et al. ..... 439/441

FOREIGN PATENT DOCUMENTS

DE 38 05 158 2/1988
DE 197 21 501 12/1997
DE 299 17 491 U1 4/2001

* cited by examiner

*Primary Examiner*—Tulsidas Patel
*Assistant Examiner*—Thanh-Tam Le
(74) *Attorney, Agent, or Firm*—Nixon Peabody LLP; David S. Safran

(57) ABSTRACT

An electrical terminal, for example a terminal block which includes a terminal housing having at least one terminal element located within, such as a tension spring terminal, and with at least one current bar. The terminal housing also includes at least one lead insertion opening for inserting an electrical lead to be connected, at least one actuating opening for inserting an actuating tool for opening the tension spring terminal and at least one test plug opening for inserting a test plug which is laterally offset from the plane of the actuating opening. This electrical terminal enables a test tap while also having smaller size than conventional electrical terminals.

12 Claims, 6 Drawing Sheets

ELECTRICAL TERMINAL

BACKGROUND OF THE INVENTION

1. Field of the Invention

The invention relates to an electrical terminal, and in particular, to a terminal block with a terminal housing having at least one terminal element, for example, a tension spring terminal, located within the housing, and at least one current bar. The terminal housing includes at least one lead insertion opening for inserting an electrical lead to be connected, at least one actuating opening for inserting an actuating tool for opening the tension spring terminal, and at least one test plug opening for inserting a test plug.

2. Description of Related Art

Electrical terminals, in particular terminal blocks, have been known for decades and are used in the millions in the wiring of electrical systems and devices. The terminals are usually locked on mounting rails which are often located in large numbers in a switch-gear cabinet. Primarily, screw-type terminals or tension spring terminals are used in the terminal blocks as the terminal elements, and the operating principle in the terminal-tension spring technology is similar to that of screw-type technology. That is, while in the screw-type terminals a tension sleeve pulls the lead against the current bar by actuating the terminal screw, in the tension spring terminal this function is performed by the tension spring. In order to perform that function, the pre-tensioned tension spring is opened with an actuating tool, e.g., a screwdriver, so that the lead can be inserted into the connection space through a window in the leg of the tension spring. After removing the actuating tool, the lead is pulled by the spring force of the tension spring against the current bar. In order to be able to insert the lead or the tip of the actuating tool into the electrical terminal, the terminal housing has a lead insertion opening and an actuating opening.

Electrical terminals are generally connecting terminals so that they have at least two terminal elements which are electrically interconnected via an electrically conductive connecting bar, that is, the current bar. In addition to this basic type of terminal block, there are a host of different types of terminal blocks which are specially adapted to specific applications. Examples are two-tier and three-tier terminals, and three-lead or four-lead terminals which then have a correspondingly larger number of terminal elements. In addition, there are terminal blocks which include a basic terminal and attachment plug. That is, the basic terminal has a terminal housing with at least one terminal element inside and at least one receptacle which is electrically connected to the terminal element. The attachment plug has at least one terminal element and a plug-in contact which is electrically connected to the terminal element. In this type of terminal block, the basic terminal is generally locked on a mounting rail and the attachment plug is plugged by means of its plug-in contact onto a corresponding receptacle of the basic terminal.

In order to be able to check the correct wiring prior to starting up a system or in order to be able to detect incorrect wiring as easily as possible in case of problems, electrical terminals are known in which in the terminal housing a test plug opening for insertion of a corresponding test plug is provided. The test plug opening enables the electrically conductive components, that is the terminal element or the current bar within the housing, to make contact with the test plug, and, as an alternative, to guide and securely fix the test plug.

With the increasing miniaturization of electrical devices and electrical systems, smaller and smaller switch-gear cabinets are desired. Since ever increasing electrical devices and systems must be wired to one another, the available space for the electrical terminals in the switch-gear cabinet is reduced. Therefore, there is an increasing need for so-called "mini-terminal blocks" which have an extremely compact construction, i.e., have only a very small width and small length.

SUMMARY OF THE INVENTION

The primary object of the present invention is to provide for an electrical terminal which enables testing while also having a very small size.

This object is achieved, for an electrical terminal, by providing a test plug opening that is located in a laterally offset manner with respect to the center plane of the terminal block and the actuating opening. In the prior art, the lead insertion opening, the actuating opening, and the test plug opening are each arranged symmetrically to the center plane, i.e., in the middle of the electrical terminal. In the present invention, the test plug opening is located in between the lead insertion opening and the actuating opening in a laterally spaced relationship with the center plane of the terminal block and the actuating opening, which enables the electrical terminal to be made with an overall dimension which is shortened when compared to those previously known.

According to a preferred embodiment of the invention, the electrical terminal is constructed such that the actuating opening and the test plug opening pass into one another, i.e., they overlap each other. Overall, then, there are only two openings, one opening being the lead insertion opening, one part of the second opening forming the actuating opening and the other part of the second opening being used as the test plug opening. In this configuration, the dimensions of the electrical terminal is still further reduced while the second opening in the terminal housing is optimally used.

There are a host of possibilities for configuring the electrical terminal which are encompassed by the present invention, particularly with regard to varying the shape, size and arrangement of the actuating opening and the test plug opening, in order to adapt to the respective use requirements, particularly when test plugs are being used at the time.

DETAILED DESCRIPTION OF THE INVENTION

Figure 1:
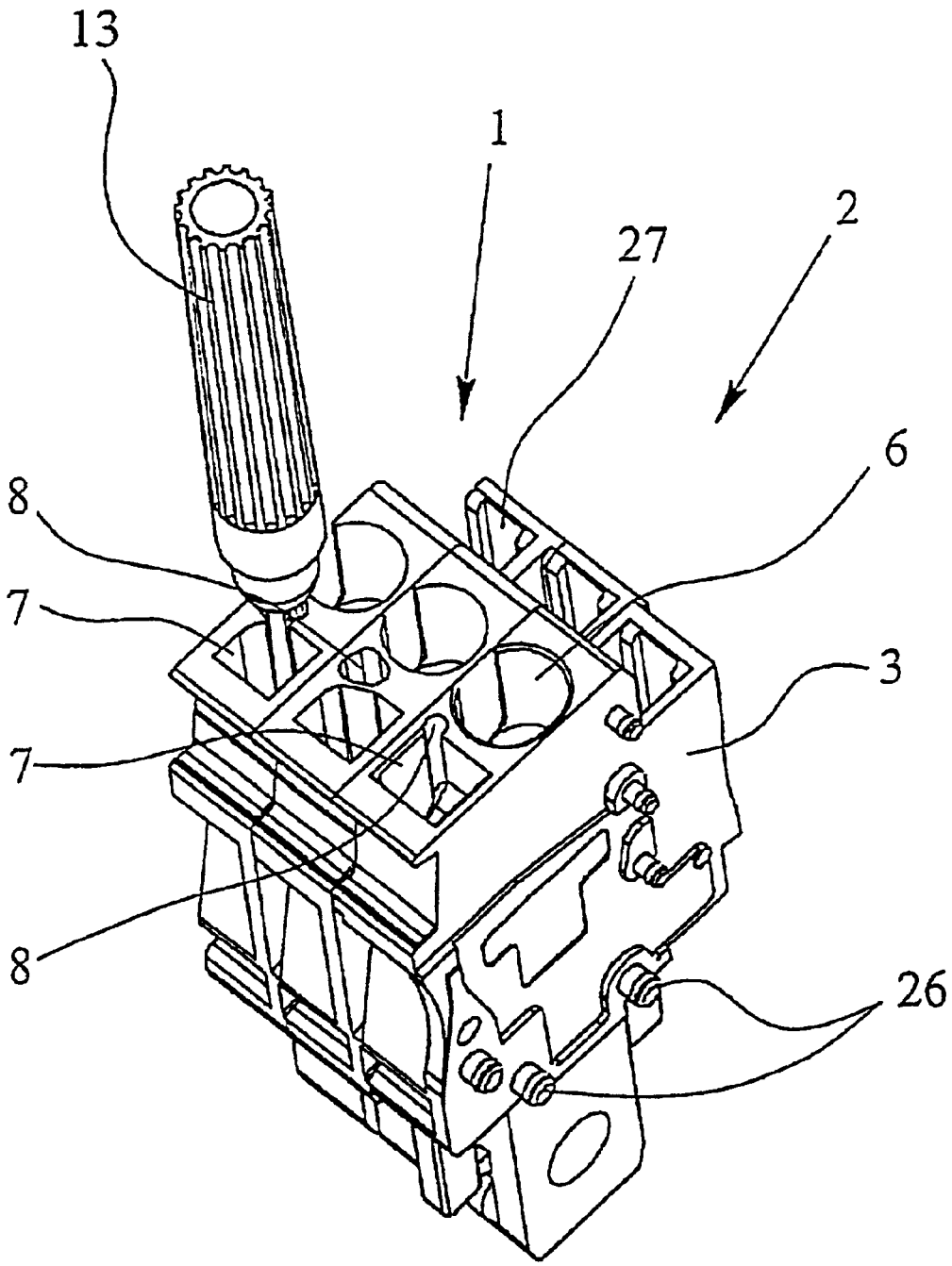
FIG. 1 shows, in an oblique overhead perspective representation, one embodiment of a terminal block of the invention including three electrical terminals.
Figure 2:
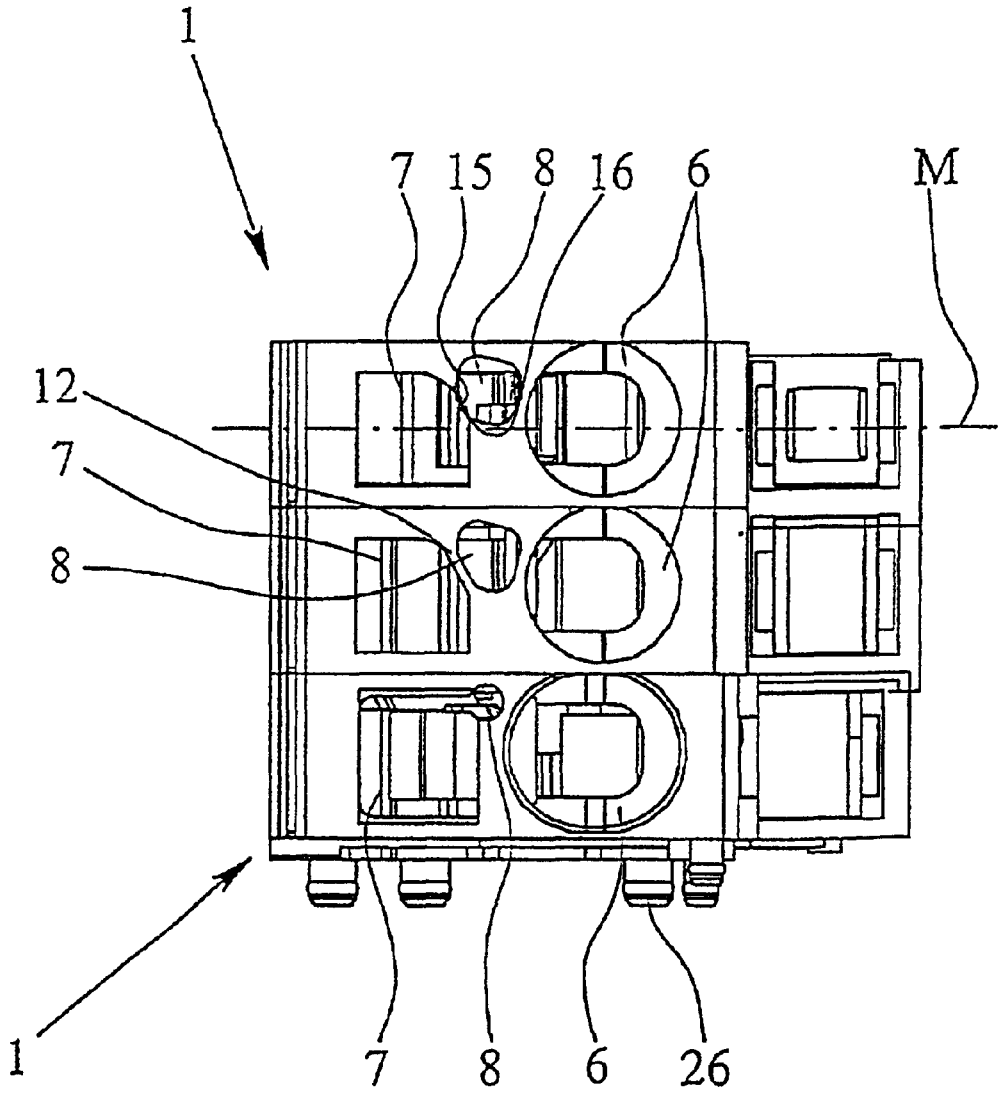
FIG. 2 is a plan view of the three electrical terminals shown in FIG. 1.
Figure 3:
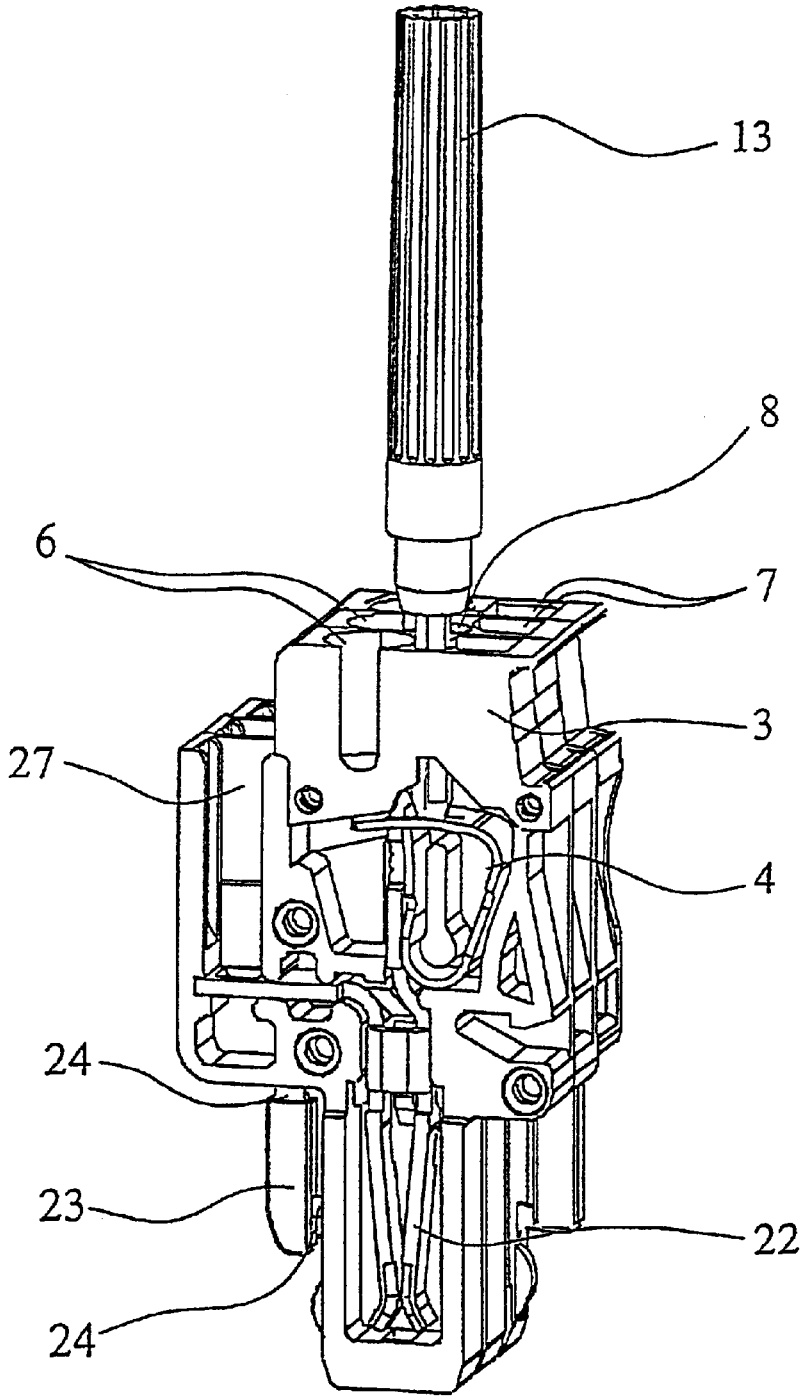
FIG. 3 shows, in an oblique side view, the three electrical terminals as shown in FIG. 1.

FIGS. 1 to 3 show three different electrical terminal blocks 1 which are mated into a connection block 2. The individual terminal blocks 1 have a terminal housing 3 in which there is one tension spring terminal 4 and one current bar 5. The tension spring terminal 4 is used for making electric contact with an electric lead (not shown) by pulling of the electrical lead by the tension spring terminal 4 against the current bar 5.

The terminal housing 3 of each electrical terminal block 1 has a lead insertion opening 6, an actuating opening 7 and a test plug opening 8. If an actuating tool, e.g., the tip of a screwdriver, is inserted into the actuating opening 7 between the housing wall 9 and the back 10 of the tension spring terminal 4 thereby pushing the recess formed in the terminal leg 11 of the tension spring terminal 4 to be under the lead insertion opening 6, then a lead can be inserted through the lead insertion opening 6 into the recess of the tension spring terminal 4. When the actuating tool is removed from the actuating opening 7, the tension spring terminal 4 springs back, so that the lead inserted into the recess is pulled against the current bar 5 and electrically connected to the terminal block 1.

As FIG. 2 shows, the test plug opening 8 is laterally offset from the center plane M of the actuating opening 7 and terminal block 1. The actuating opening 7 and the test plug opening 8 can be separated from one another by a thin wall 12, as is the case in the middle terminal block 1 in FIG. 2. However, preferably, the actuating opening 7 passes into or overlaps the test plug opening 8. Since the lead insertion opening 6 has an essentially round cross section, the lead insertion opening 6 and the actuating opening 7 can be arranged closer to one another by the arrangement of the test plug opening 8 being laterally offset to the center plane M.

The shape and size of the test plug opening 8 can be chosen according to the version of the test plug 13. If the test plug 13 has only one relatively thin cylindrical pin, the test plug opening 8 can be made as a hole with a small diameter, as is the case in the lower terminal block 1 in FIG. 2. If, conversely, a test plug 3 has a multi-wire contact pin 14, the contact pin 14 will have a roughly square cross section, so that the test plug opening 8 is accordingly is of a square shape.

Figure 4:
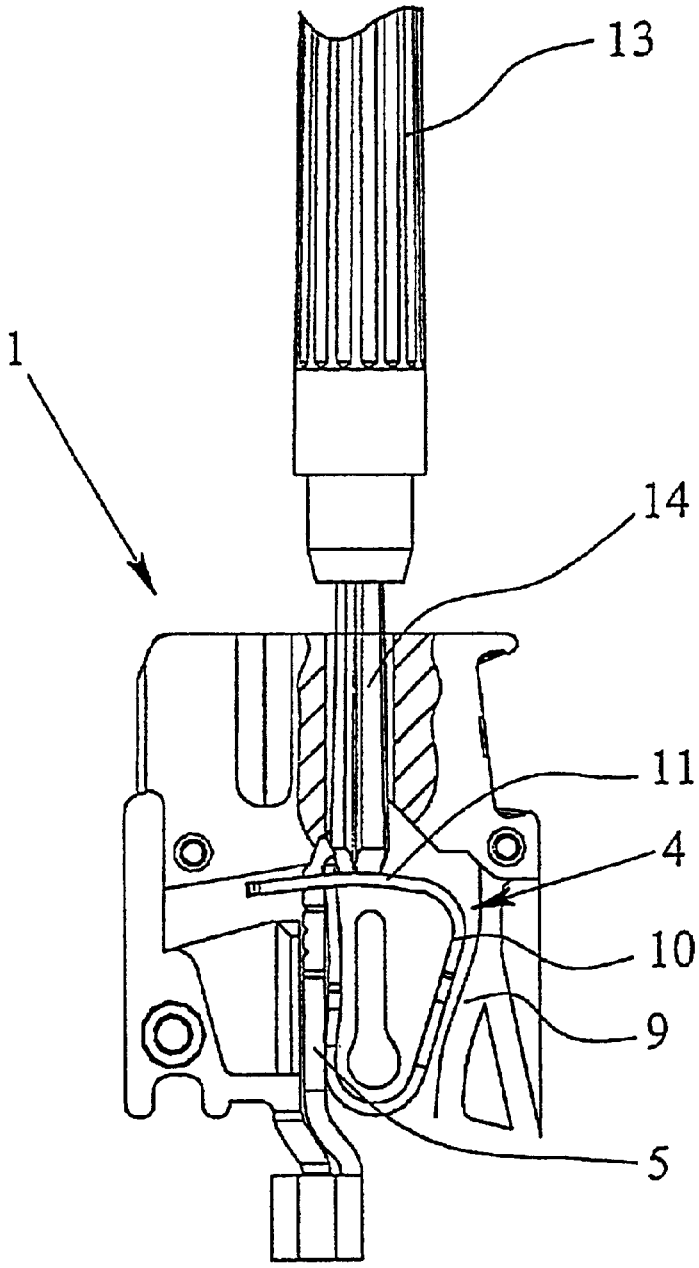
FIG. 4 shows, in a partial side cutaway view, an enlarged representation of one cutout of the electrical terminal of the invention.

If the actuating opening 7 and the test plug opening 8 according to the preferred embodiment overlap one another, the width of the passage 15 between the actuating opening 7 and the test plug opening 8 is smaller than the diameter or the width of the test plug 13 or of the contact pin 14. The passage 15 between the actuating opening 7 and the test plug opening 8 is bordered by projections 16 which project into the actuating opening 7. This ensures that the test plug 13 when inserted into the test plug opening 8 is guided by the test plug opening 8, while the test plug 13 is prevented from slipping over into the actuating opening 7. In the arrangement of the tension spring terminal 4 shown in FIGS. 3 and 4, an actuating tool, when inserted into the actuating opening 7, is pressed against the edge of the actuating opening 7 facing away from the lead insertion opening 6. Because the test plug opening 8 is located on the side of the actuating opening 7 facing the lead insertion opening 6, the test plug opening 8 does not adversely affect the insertion of an actuating tool into the actuating opening 7.

Figure 5:
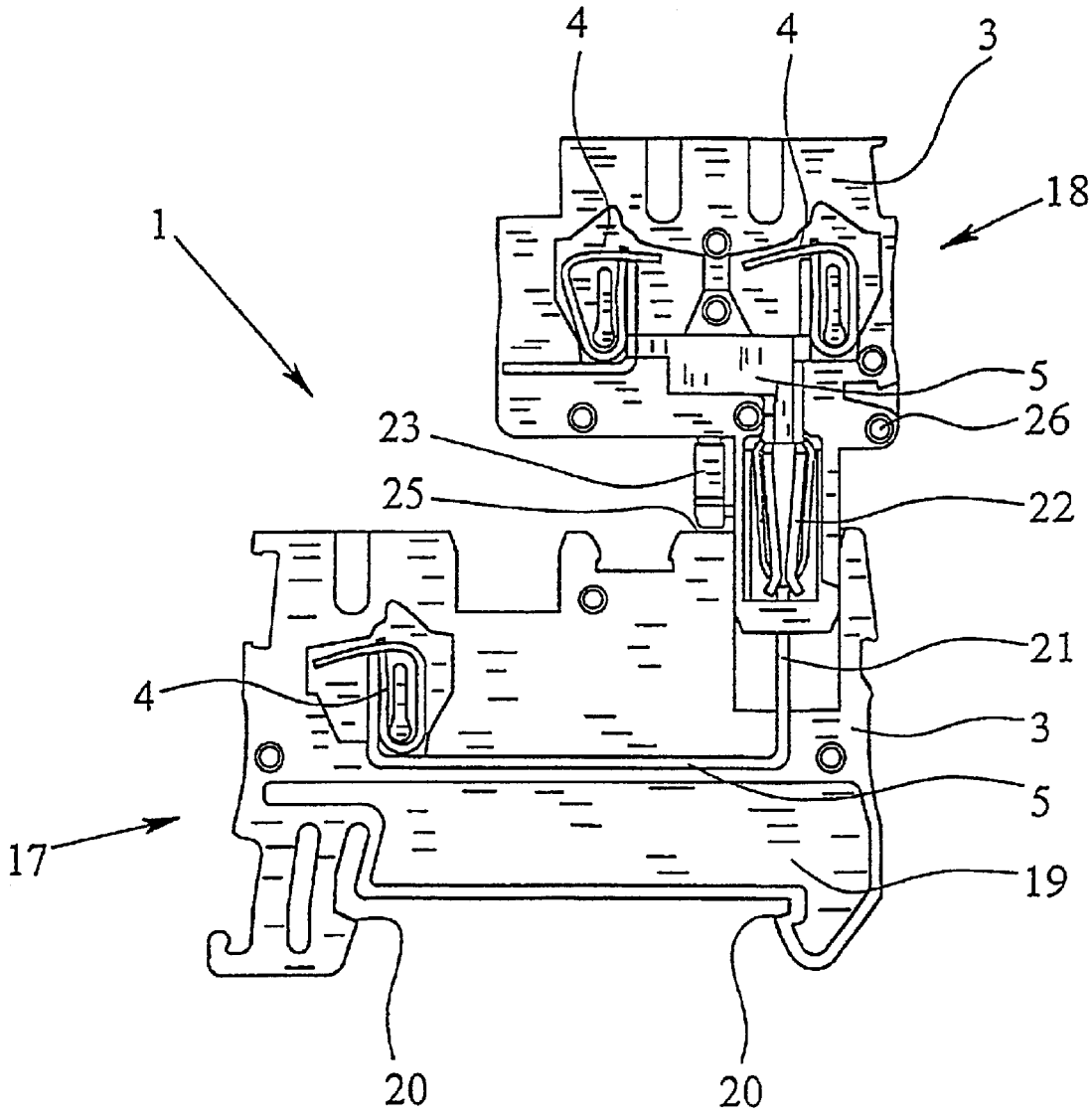
FIG. 5 shows a electrical terminal block which includes a basic terminal and an attachment plug.

FIG. 5 shows an embodiment of an electrical terminal block 1 which includes a basic terminal 17 and an attachment plug 18. The basic terminal 17 can be locked on a mounting rail (not shown), for which in the base 19 of the basic terminal 17 the corresponding catch elements 20 are formed. The connection of the basic terminal 17 to the attachment plug 18 is made via a plug pin 21 in the basic terminal 17, which is connected integrally to the current bar 5, and a plug sleeve 22 in the terminal plug 18. Instead of the attachment plug 18, shown in FIG. 5, as having two tension spring terminals 4 for connection of two electrical leads, the electrical terminal blocks shown in FIGS. 1 to 4 can be plugged with their plug sleeves 22 into the plug pin 21 of the basic terminal 17.

FIGS. 3 and 5 show that there is a polarization element 23 on the electrical terminal block 1 or on the attachment plug 18. The polarization element 23 is connected via thin connecting bridges 24, made as scored sites, to the terminal housing 3. In this way the polarization element 23 can be easily separated by hand from the terminal housing 3 and inserted into an opening 25 which is made in the basic terminal 17. The basic terminal 17 can thus be easily polarized, ensuring that only the "correct" attachment plug 18 is connected to the basic terminal 17.

FIG. 1 also shows that on the terminal housing 3 there are several catch elements 26 which are used to connect the individual electrical terminal blocks 1 to one another. To do this, the individual terminal housings 3 are mated using the catch elements 26 and corresponding catch recesses (not shown). FIGS. 1 to 3, moreover, show that the terminal housing 3 has another opening 27 into which a bridge or a shorting plug can be inserted for electrical shorting of two or more adjacent electrical terminal blocks 1.

Figure 6A:
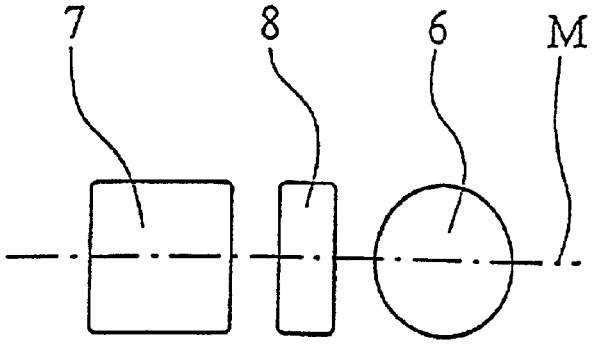
Fig. 6A (Prior Art)
FIGS. 6*a*–6*e* show a schematic of different arrangements of the line insertion opening, the actuating opening and the test plug opening of the invention.
Figure 6B:
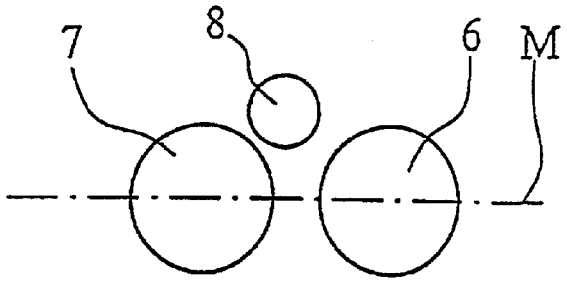

FIG. 6A shows, first of all, the arrangement of the lead insertion opening 6, the actuating opening 7 and the test plug opening 8 in a terminal block 1 known from the prior art. The test plug opening 8 is located in the middle between the lead insertion opening 6 and the actuating opening 7 and in the same way as the lead insertion opening 6 and actuating opening 7 symmetrically to the center plane M. Conversely, in the representation as shown in FIG. 6B, the test plug opening 8 of the invention is arranged in a laterally offset manner from the center plane M of the actuating opening 7 on the terminal block. In the representation in FIG. 6B, next to the lead insertion opening 6 the actuating opening 7 is also made as a round opening. By means of this arrangement of the test plug opening 8, which is laterally offset to the center plane M the lead insertion opening 6 and the actuating opening 7, a shorter distance between the openings can be achieved than is the case in the arrangement as shown in FIG. 6A, by which an electrical terminal 1 can be made with dimensions which are smaller in the direction of the center plane M.

Figure 6C:
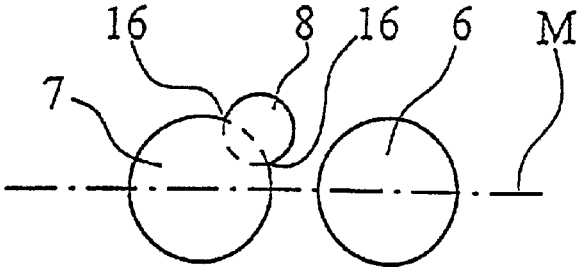
Figure 6D:
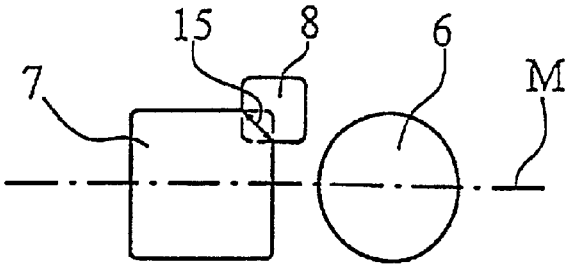
Figure 6E:
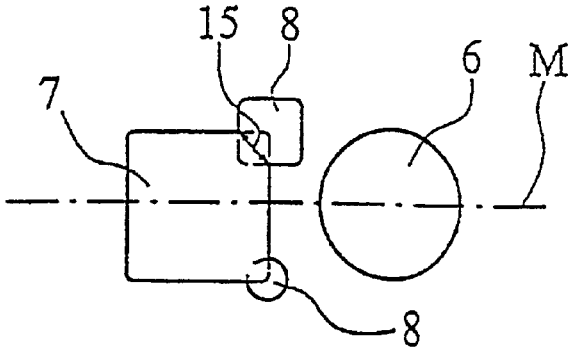

The possible arrangements of the lead insertion opening 6, the actuating opening 7 and the test plug opening 8 of the invention as shown in FIGS. 6C to 6E differ from the arrangement as shown in FIG. 6B in that the actuating opening 7 and the test plug opening 8 pass into one or overlap each other. The more or less "overlapping" of the actuating opening 7 and the test plug opening 8 is indicated by the dashed representation of the edge of the actuating opening 7 or test plug opening 8, which edge is not present.

In the embodiment shown in FIG. 6C, the actuating opening 7 and the test plug opening 8 each have a round cross section, while, in the actuating opening 7 and the test plug opening 8 in the embodiment shown in FIG. 6D are each made square. The shape and size of the test plug opening 8 depends on the shape and size of the test plug 13 used. In the embodiment shown in FIG. 6E, in contrast to the other embodiments, another test plug opening 8 is provided which overlaps the actuating opening 7. A terminal block 1 of this embodiment makes it possible to insert different test plugs 13 depending on their cross section into one of the two test plug openings 8.

What is claimed is:

1. An electrical terminal comprising:

a terminal housing, at least one tension spring terminal having a leg with an opening and at least one current bar located within the terminal housing, at least one lead insertion opening in a wall of the terminal housing for inserting an electrical lead to be electrically connected, at least one actuating opening in the wall of the terminal housing for inserting an actuating tool for opening the tension spring terminal so that the lead can be inserted into the connection space through the opening in the leg of the tension spring terminal, and at least one test plug opening in the wall of the terminal housing between the at least one insertion opening and the at least one actuating opening for inserting a test plug, wherein the lead insertion opening, the actuating opening and the test plug opening are located on the same side of the terminal housing and wherein the test plug opening is in a laterally offset position relative to a center plane of the actuating opening.

2. The electrical terminal as set forth in claim 1, wherein the actuating opening and the test plug opening at least partially overlap each other.

3. The electrical terminal as set forth in claim 2, wherein the actuating opening has an essentially rectangular shape and one corner of the actuating opening includes at least a portion of the test plug opening.

4. The electrical terminal as set forth in claim 1, wherein the test plug opening is a hole which is small in relation to the lead insertion opening.

5. The electrical terminal as set forth in claim 1, wherein the test plug opening is essentially rectangular.

6. The electrical terminal as set forth in claim 2, wherein a passage is formed between the actuating opening and the test plug opening in which a width of the passage is less than a diameter of the test plug opening.

7. The electrical terminal as set forth in claim 6, wherein the actuating opening and the test plug opening are separated from one another by projections which define the width of the passage.

8. The electrical terminal as set forth in claim 1, wherein the electrical terminal is a terminal block.

9. The electrical terminal as set forth in claim 8, wherein the terminal block comprises a basic terminal portion adapted for mounting to a mounting rail and an attachment plug portion containing the terminal housing wherein the basic terminal portion and the attachment plug portion include a means to detachably connect the basic terminal portion and the attachment plug portion in order to establish an electrical connection therebetween.

10. The electrical terminal as set forth in claim 9, wherein the means to detachably connect the basic terminal portion and the attachment plug portion in a plug element on the attachment plug portion a socket on the basic terminal portion.

11. The electrical terminal as set forth in claim 1, wherein the test plug opening is in a laterally offset position relative to a center plane of the actuating opening and the terminal housing.

12. An electrical terminal comprising:

a terminal housing, at least one terminal element and at least one current bar located within the terminal housing, at least one lead insertion opening in a wall of the terminal housing for inserting an electrical lead to be electrically connected, at least one actuating opening in the wall of the terminal housing for inserting an actuating tool for connecting the electrical lead, and at least one test plug opening in the wall of the terminal housing between the at least one insertion opening and the at least one actuating opening for inserting a test plug, wherein the test plug opening is in a laterally offset position relative to a center plane of the actuating opening, wherein the actuating opening and the test plug opening at least partially overlap each other, and wherein the actuating opening has an essentially rectangular shape and one corner of the actuating opening includes at least a portion of the test plug opening.

* * * * *